United States Patent [19]

Chmielnik

[11] Patent Number: 4,774,885

[45] Date of Patent: Oct. 4, 1988

[54] PRINTING PROCESS OVERLAYING MULTI-COLOR DOT IMAGES

[76] Inventor: Reinhold Chmielnik, 109 Steele Home Ct., R.R. #1, Bolton, Ontario, Canada, L0P 1A0

[21] Appl. No.: 513,336

[22] Filed: Jul. 13, 1983

Related U.S. Application Data

[63] Continuation of Ser. No. 291,635, Aug. 10, 1981, abandoned.

[51] Int. Cl.[4] ..... B41M 1/10

[52] U.S. Cl. ..... 101/170; 101/151; 101/152; 101/211; 430/301; 430/307; 428/909

[58] Field of Search ..... 101/211, 32, 170–171, 101/34, 450.1, 450.2, 151–152, 150, 426, 38 R–38 A, 175; 430/301, 307; 428/909

[56] References Cited

U.S. PATENT DOCUMENTS

| | | | |
|---|---|---|---|
| 987,351 | 3/1911 | Fell | 101/170 |
| 2,063,614 | 12/1936 | McFarlane et al. | 101/150 |
| 2,853,003 | 9/1958 | Kaldschmidt et al. | 101/175 X |
| 2,980,015 | 4/1961 | Zewtner et al. | 101/170 |
| 3,261,289 | 7/1966 | Cash et al. | 101/38 R |
| 3,371,603 | 3/1968 | Brigham | 101/175 |
| 3,390,631 | 7/1968 | Koszul | 101/170 X |
| 3,392,667 | 7/1968 | Cassel et al. | 101/211 |
| 3,394,652 | 7/1968 | Marsh et al. | 430/301 |
| 3,426,679 | 2/1969 | Rhines | 101/175 |
| 3,470,054 | 9/1969 | Tyrrell | 101/211 X |
| 3,701,317 | 10/1972 | Miyamoto et al. | 101/170 |
| 3,735,697 | 5/1973 | Provan | 101/175 X |
| 3,740,222 | 6/1973 | McGlashan, Sr. | 430/301 |
| 3,752,072 | 8/1973 | Lorber | 430/301 X |
| 3,772,016 | 11/1973 | Anderson, Jr. et al. | 101/211 X |
| 3,902,415 | 9/1975 | Fischer | 101/175 |
| 3,934,500 | 1/1976 | Jackson | 101/38 M |
| 3,948,171 | 4/1976 | O'Connell | 430/301 X |
| 4,012,257 | 3/1977 | Geris | 430/301 |
| 4,019,436 | 4/1977 | Handweiler et al. | 101/170 |
| 4,035,214 | 7/1977 | Shuppert et al. | 101/211 X |
| 4,056,056 | 11/1977 | Glorl | 101/175 |
| 4,111,120 | 9/1978 | Paulson | 101/175 |
| 4,142,462 | 3/1979 | Gilgore | 101/211 X |
| 4,217,822 | 8/1980 | Milligan | 430/301 X |
| 4,301,727 | 11/1981 | Bardin | 101/170 |
| 4,324,179 | 4/1982 | Nagano | 101/170 |

FOREIGN PATENT DOCUMENTS

| | | | |
|---|---|---|---|
| 2343102 | 3/1975 | Fed. Rep. of Germany | 101/175 |
| 1014623 | 8/1952 | France | 101/38 R |

OTHER PUBLICATIONS

"Relief & Intaglio Color Printers", IBM Technical Disclosure Bulletin, vol. 21, No. 12, May 1979, pp. 4811–4812.

*Primary Examiner*—E. H. Eickholt
*Attorney, Agent, or Firm*—Sim & McBurney

[57] ABSTRACT

A multicolor half-tone image of an original object is formed on preformed plastic containers or other recipient surface by printing such image while wet from an offset blanket cylinder on which the image is formed by overlying a plurality of one-color half-tone images.

10 Claims, 1 Drawing Sheet

FIG.1.
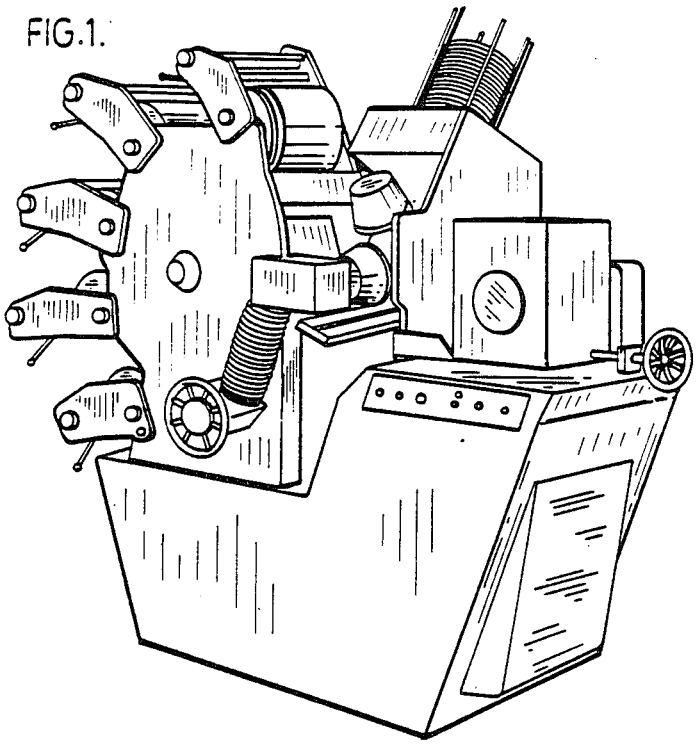
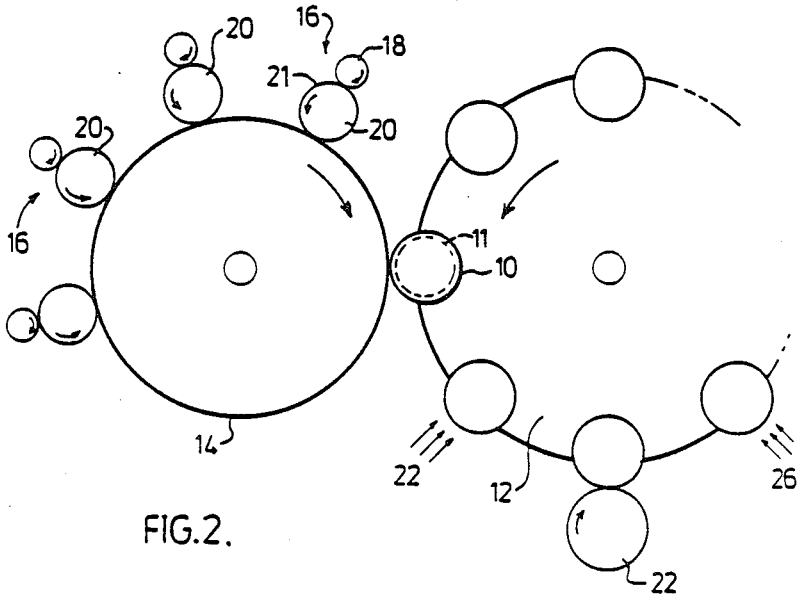
FIG.2.

PRINTING PROCESS OVERLAYING MULTI-COLOR DOT IMAGES

This application is a continuation of U.S. Ser. No. 291,635, filed Aug. 10, 1981 and now abandoned.

FIELD OF INVENTION

The present invention relates to a printing process.

BACKGROUND TO THE INVENTION

There are a number of printing processes which have been in common use, both for printing continuous paper web sheets and for printing preformed articles, such as, plastic containers and lids for such containers. The printing of paper web sheets usually is effected by letterpress or relief printing, offset-lithography or gravure printing.

In letterpress or relief printing, image areas are raised in relief above non-image areas. Ink is applied by rollers to the raised surfaces and transferred directly onto paper. This type of printing uses metal type, engravings and forms combining both.

Litho plates for wet offset printing carry both the image and non-image areas on the same plane or level while those for dry offset have raised relief image areas. In wet offset, the image areas are photoprinted onto a thin metal plate that has been chemically sensitized to accept ink and repel water on the image area. The plate first contacts rollers of water or dampening solution, then inked rollers. In dry offset, the water rollers are omitted and the ink rollers contact the relief image. In both cases, the inked image is transferred or offset from the plate to a rubber blanket cylinder, and then onto paper. The resilience of the rubber blanket permits offset lithography on a wide range of texture surfaces.

Gravure printing is the opposite of relief printing, in that the etched image areas are recessed into a metal plate to form reservoirs or wells for ink. The total image area is screened with the depths of the wells controlling the amount of ink transferred and density of tone on paper. The etched cylinder rotates in a fountain of ink, so filling the wells. A doctor blade wipes ink from the non-recessed, non-image areas of the plate. The image is then transferred directly from the plate onto paper. Gravure provides quality reproduction on both smooth and textured surfaces.

When it is desired to produce multicolor printings, wherein primary printing colors, namely, yellow, red (magenta), blue (cyan) and black, overlap to provide shadings of color on the paper, separate gravure printing stations are used for each color, with the previous color image drying, as it passes from one color printing station to the next such station, before application of the next color image.

In the printing of preformed containers, offset printing generally has been used. Where multiple color printings are required, these are formed by a plurality of printing stations arranged around the blanket cylinder to print separate color images of heat set ink thereon for transfer to the container. To provide for reproducibility of the desired printing on a subsequent article and avoid quality impairment due to residual mixed paint on the blanket, the colors are printed in non-overlapping relationship on the blanket.

SUMMARY OF THE INVENTION

In accordance with the present invention, there is provided a novel printing process which is particularly useful for printing preformed articles, especially preformed plastic containers, but is also useful for printing sheet material, including paper webs. In the present invention, a four-color half-tone image is formed on an offset blanket cylinder and is transferred therefrom to the recipient surface. In this way, it is possible to provide a reproduction of a photograph on a preformed container.

GENERAL DESCRIPTION OF INVENTION

The first step in the formation of the four-color half-tone image on the offset cylinder blanket is to effect color separation of an original image into separate half-tone images in the colors yellow, red, blue and black. This color separation procedure is conventionally carried out in gravure printing and involves photographing the original through a finely lined screen to provide a picture whose lights, shadows and colors are composed of minute dots of a single color.

Separate printing plates suitable for mounting on a printing roller, are then formed for each of the single color images. the printing plate may take the form of a wet or dry offset plate or may have etched image areas, such as are used in gravure printing. The printing plate may also have a relief image such as is used in relief printing.

In offset lithographic printing, the image is usually formed on the printing plate while the plate is in a planar condition, with the image being distorted in an attempt to take into account the curved surface of the printing cylinder. This latter procedure is unsatisfactory when half-tone images are formed on the printing plates, as is effected in this invention, since proper registry of the single color dots on the offset blanket cannot be effected.

In accordance with a preferred embodiment of the invention, the one-color half-tone images are formed in an undistorted manner on the printing plates while the latter are held in a curved condition having a radius of curvature which is that of the printing cylinder. The assembly of the one-color half-tone image printing plate and the printing cylinder is similar to a gravure printing roller, in terms of the one-color half-tone nature of image which is present on the printing cylinder.

The individual one-color half-tone plates are mounted on printing cylinders which are arranged at four arcuately spaced locations around the periphery of an offset blanket cylinder at separate one-color printing stations, so as to sequentially print one-color half-tone images on the offset blanket cylinder to form a four-color half-tone wet image thereon. The individual colors are provided by ultra-violet drying process inks in the primary colors of yellow, red, blue and black. It is preferred to print these colors onto the offset blanket cylinder in the sequence of black, blue, red and yellow, although other sequences may be employed. The latter sequence is the reverse of the order of printing of these colors in gravure printing.

As noted previously, in gravure printing of a four-color half-tone image, the one color half-tone images are sequentially printed directly onto the recipient paper web, with intermediate drying. However, in this invention the four-color half-tone image is first formed on the offset blanket cylinder, prior to transfer to the recipient surface. Since the colors are printed on the offset blanket cylinder in the reverse order from the printing of those colors in gravure printing, the image which is printed on the recipient surface, in effect, possesses the colors printed in the same order as has been found satisfactory in gravure printing.

The individual one-color half-tone images print sequentially on the offset blanket cylinder, with the individual dots of sequential colors standing alone, overlapping or registering, as dictated by the color separation of the original photograph. At locations of dot overlap or registry, the colors blend. In this way, a four-color half-tone image, which is a reproduction of the originally photographed object, is obtained in a wet-form, suitable for printing onto a recipient surface, preferably a preformed article, such as, a plastic container.

Once the image is transferred to the article, the image is dried thereon, for example, by ambient air drying or hot air drying, as desired, and may be protected, such as by a transparent lacquer layer, if desired.

The utilization of half-tone images, comprising a multitude of closely spaced dots, on the offset blanket has a significant advantage over solid color images, in that the open spaces between the dots serve to assist in transfer of all the wet ink from the blanket onto the recipient surface. Solid color images usually have only a few such gaps and some ink inevitably remains on the blanket. The successful transfer of all the ink of the image to the recipient surface means that the quality of the reproduction is not impaired for the next printing.

Some minor contamination does inevitably occur and the blanket needs to be cleaned, as occurs in conventional offset lithographic printing after an extended run, for example, 25,000 to 50,000 containers.

The printing process of the invention uniquely forms a wet four-color half-tone image on an offset blanket cylinder suitable for printing on a recipient surface, especially a preformed article, such as a plastic container, and very significantly from all other known printing processes.

The printing process of the invention resembles gravure printing in terms of the form of the end result, i.e. a four-color half-tone image which is a reproduction of a physical object, but differs significantly therefrom in several respects.

In gravure printing, the individual one-color half-tone images are printed sequentially directly on the recipient paper web with drying of the individual images between printings. In contrast, in this invention, a wet multicolor half-tone image is formed on an offset blanket cylinder before transfer to the recipient surface, which may be the outer surface of a preformed container.

In gravure printing, the individual one-color half-tone images are printed on the paper web from etched printing cylinders whereas, in this invention, the individual one-color half-tone images are printed onto the offset blanket cylinder from a printing cylinder comprising a thin curved metal printing plate mounted on a cylinder.

The printing process of the invention differs from normal offset printing in the form of image which is formed on the blanket cylinder. In conventional offset printing, either a single color image is formed on the offset blanket cylinder for transfer to a recipient surface or a multicolor solid non-overlapping color image is formed on the offset blanket cylinder for transfer to a recipient surface, which may be the surface of a preformed container. In contrast, in this invention, a multicolor half-tone image is formed on the offset blanket cylinder for transfer to a recipient surface, which may be the surface of a preformed container.

The printing process of the invention also differs from letterpress or relief printing. While this invention may use a relief plate to print the individual one-color half-tone images on the blanket cylinder, normal relief printing involves single color direct printing onto a paper web.

BRIEF DESCRIPTION OF DRAWINGS

FIG. 1 is a perspective view of a typical preformed container printing apparatus; and FIG. 2 is a schematic representation of a printing apparatus suitable for carrying out the process of the invention.

DESCRIPTION OF PREFERRED EMBODIMENT

Referring first to FIG. 1, there is illustrated therein a typical printing apparatus for carrying out sideby-side multicolour printing on preformed containers. Individual solid colour image printing stations are arranged around an offset blanket cylinder onto which the individual colours are printed in non-overlying relationship on the blanket to form the image desired on the container. This is transferred to the exterior surface of the container. Any colour required in the image is premixed and separately applied, in the drawing, five separate colour printing stations being used.

The procedure of the invention has only superficial similarity to such a procedure, as discussed in detail above, although the external appearance of the equipment used is similar to that seen in FIG. 1. However, only four primary colour stations are required, half-tone images of the four colours are applied to the blanket in overlapping relationship, and the resulting four-colour half-tone image is applied to the container, in contrast with the multiple ready-blended colour stations which apply solid images in side-by-side non-overlapping manner on the blanket in the prior art.

The procedure of the invention is described with respect to the schematic representation of FIG. 2. Preformed plastic containers 10 onto which a multicolour image is to be printed are mounted in known manner on individual holders 11 on a rotating multiholder rotatable wheel 12. An offset blanket cylinder 14 has a plurality of individual one colour image-applying stations 16 arranged therearound consisting of an inking roller 18 and a printing cylinder 20 having a thin metal printing plate 21 bearing appropriate one-colour half-tone image.

The printing plate 21 may take any desired form, for example, a dry offset plate, a wet offset plate or a rotogravure-like plate.

The one-color half-tone images are successively printed on the offset blanket cylinder 14 in overlying manner, so that a wet four-color half-tone reproduction of the original object is formed on the blanket cylinder 14 after the last applying station 16. This multicolor half-tone image is transferred while still wet to the container 10. The printed image on the container 10 then may be dried, such as by the application of hot air at 22, and an outer coat of varnish may be applied at a varnishing station 24 and the varnish subsequently dried, such as by the application of hot air at 26.

SUMMARY OF DISCLOSURE

In summary of this disclosure, the present invention provides a novel printing process which enables multicolor half-tone image printing to be effected on a preformed container or other recipient surface. Modifications are possible within the scope of the invention.

What I claim is:

1. A method of printing a full multicolor image of an original object on a recipient surface which comprises:

forming a plurality of printing plates each bearing a one-color half-tone image of said original object, forming a wet full multicolor half-tone image corresponding in appearance to the original object and comprising a multitude of closely-spaced single-color dots, which are separate, overlap or in register as determined by the image, on a resilient printing blanket by successively printing wet one-color half tone dot images from said printing plates directly onto said resilient printing blanket, and transferring said image while wet from said resilient printing blanket to said recipient surface by direct surface-to-surface contact between said printing blanket and said recipient surfaces, whereby a full multicolor image corresponding to the appearance of an original object is provided on said recipient surface.

2. The method of claim 1 wherein the color are four in number and comprises yellow, red (magenta), blue (cyan) and black.

3. The method of claim 2 wherein said one-color images are printed on said resilient printing blanket in the order black, blue, red and yellow.

4. A method of forming a multicolor image of an original object on the external surface of a preformed container, which comprises:

providing four printing plates each bearing one of four one-color half-tone images of said original object for the colors of yellow, red (magenta), blue (cyan) and black, printing individual wet one-color half-tone dot images from each of said printing plates in registry in the color of yellow, red, blue and black onto a resilient printing cylinder to form a wet four-color half-tone image corresponding in appearance to the original object and comprising a multitude of closely-spaced single-color dots which are separate, overlap or in register as determined by the original object, and transferring said four-color half-tone image while wet from said printing cylinder to said external surface of said preformed container by direct contact between said resilient printing cylinder and said external surface.

5. The method of claim 4 wherein said printing plates are of the type used in dry-offset printing and said printing of said one-color half-tone images on said resilient printing cylinder is effected by the procedure of dry-offset printing.

6. The method of claim 4 wherein said printing plates are of the type used in wet-offset printing and said printing of said one-color halftone images on said resilient printing cylinder is effected by the procedure of wet-offset printing.

7. The method of claim 4 wherein said printing plates are rotogravure-like printing plates and said printing of said one-color half-tone images on said resilient printing cylinder is effected by direct contact between said rotogravure-like printing plate and said resilient printing cylinder.

8. The method of claim 4 wherein said printing plates are of thin sheet metal material, said printing of said one-color half-images therefrom is effected by mounting said printing plates on a printing cylinder for direct engagement with said resilient printing cylinder, and said one-color half-tone images are formed on said thin sheet metal while the latter is maintained in a curved form corresponding to its curved form when mounted on said printing cylinder.

9. The method of claim 8 wherein said one-color half-tone images are printed on said resilient printing cylinder in the sequential order of black, blue, red and yellow.

10. A method of forming a multicolor representation of an original object on the external surface of a preformed container, which comprises:

photographing said object in full color to provide a full-color photograph of said object, separating said full-color photograph into four individual one-color dot images for the colors of yellow, red (magenta), blue (cyan) and black in the photograph, transferring each of said four one-color images onto a separate printing plate to provide four printing plates each bearing one of said four one-color half-tone dot images, applying ink to each said printing plate in the color of the image from which the one-color half-tone image on the plate is formed, printing individual wet one-color half-tone dot images from each of said printing plates in registry with respect to the image in said full color photographs and in the colors of yellow, red, blue and black onto a resilient printing cylinder to form a wet four-color half-tone image corresponding to said photograph and comprising a multitude of closely-spaced single-color dots which are separate, overlap or in registry as determined by the photograph, transferring said four-color half-tone image while wet from said resilient printing cylinder to said external surface of said preformed container by direct contact between said resilient printing cylinder and said external surface, whereby said wet four-color half-tone image is released from said resilient printing cylinder and printed on said external surface, and drying the tranferred image on said external surface to provide a multicolor representation of the original object on said preformed container

* * * * *